United States Patent [19]

Zimmerman

[11] 4,108,514

[45] Aug. 22, 1978

[54] PHONOSTAND

[75] Inventor: Heinrich Zimmerman, St. Georgen, Schwarzwald, Fed. Rep. of Germany

[73] Assignee: Dual Gebrüder Steidinger, St. Georgen, Schwarzwald, Fed. Rep. of Germany

[21] Appl. No.: 843,432

[22] Filed: Oct. 18, 1977

[51] Int. Cl.[2] ..... A47B 53/00; A47B 87/00

[52] U.S. Cl. ..... 312/107; 312/108; 312/111; 312/198

[58] Field of Search ..... 312/107, 108, 111, 198, 312/225, 8, 9

[56] References Cited

U.S. PATENT DOCUMENTS

| | | | |
|---|---|---|---|
| 3,234,896 | 2/1966 | Bonsall | 312/111 |
| 3,583,780 | 6/1971 | Berkowitz | 312/108 |
| 3,644,008 | 2/1972 | Overby | 312/107 |
| 3,748,009 | 7/1973 | Stone | 312/111 |
| 3,754,806 | 8/1973 | Nakagawa | 312/111 |
| 3,814,489 | 6/1974 | Clark et al. | 312/111 |
| 3,848,942 | 11/1974 | Fanini | 312/111 |

*Primary Examiner*—Kenneth Downey
*Assistant Examiner*—Victor N. Sakran
*Attorney, Agent, or Firm*—Martin A. Farber

[57] ABSTRACT

A stand which is assemblable by laymen for insertion of phono-devices, accessory units and sound carriers, which is able to be expanded starting from a base unit which corresponds to a so-called phonotable, by mounting thereon assembly elements, which respectively form a stand compartment.

5 Claims, 3 Drawing Figures

PHONOSTAND

The invention relates to a stand for the insertion or setting up of electro-acoustic devices of general use, the individual parts of which are able to be put together by a layman.

For insertion or setting up of electro-acoustical devices, particularly those which frequently must be attended, such as record players and tape recorders, so-called phonotables have proved successful. These tables partially are able to be assembled by laymen. The assemblability serves for the reduction of the transportation costs from the manufacturer to the consumer. The tables nevertheless however must be properly stable since the devices to be placed thereon in part are heavy and the tables also are shifted back and forth. Partially they are provided with one compartment for the insertion of an additional device, for example, an amplifier for the turntable set up above. The ability for expansion for further devices or sound carriers or tape recorders does not exist.

It is known to construct assemblable stands and cabinets, respectively, for residential purposes such that a base element can be expanded by means of annexed or built-on assembly elements. The mountable element thereby is made of a type of closed box frame with a rear wall, whereby the cover plate of the lower base element is screwed with the bottom plate of the element mounted thereon. The disadvantage of such an arrangement resides in that apart from the material expense it appears no good on the one hand when two horizontally disposed plates lie on one another, and on the other hand each element requires a rear wall corresponding to its height, that is different heights, which is inserted in a fold or bend of the remaining walls and is fastened with a considerable number of screws, so that its front end face sides are not visible.

Further metal fittings or mountings of furniture are known which permit a vertical wall to be anchored from above onto a bottom plate. Such mountings and their assembly, respectively, are rather expensive and their application is suited only for places which do not lie in the direct field of view.

It is an object of the present invention to provide compartmentwise expandability to a stand system corresponding to individual requirements of the introductory mentioned phonotable, in order to be able to accommodate the versatile auxiliary units and also sound carriers or tape units, and under circumstances from time to time again also to be able to dismount or rebuild the system.

The core of the present invention lies in that on a base unit which corresponds in its dimensions to that of a conventional phonotable, an assembly element respectively is mountable thereon, the assembly element having the shape of an inverted U's.

By the invention the previously mentioned disadvantages are avoided and the widening ability is facilitated in a comparatively simple manner. Thus, for example, for the base elements and all assembly elements of different heights, identical reinforcement members can be used, so that these parts can be produced of synthetic material plastic molded parts. Moreover these reinforcement parts do not need to be inserted in folds or the like, since they possess smooth face or front end surfaces, which can remain visible. Such type of synthetic material plastic form parts moreover can be constructed in the size of the remaining plates without consideration of their actual wall strength or thickness, which offers advantages of shape and form. Moreover these synthetic material molded parts simultaneously provide for a sufficient anchoring for normal use against an unintentional lifting of an assembly element.

It is another object of the present invention to aid the solution of the above-mentioned object and to provide a stand for insertion or setting up electro-acoustical devices of general use, the individual parts of which may be assembled by a layman, comprising a base element, which is formed by screwing a bottom plate and a cover plate to the end face sides of two side walls, and is rigidified by screwing a reinforcement member on the rear end face sides of the two side walls, the reinforcement member comprising a plate-shaped synthetic material molded part which occupies only a portion of the entire height of the rear side of the base element, and on the base element (the dimensions of which correspond approximately to that of a conventional phonotable), one or a plurality of assembly elements of the same width having the same or different heights are mounted with the aid of fixing means, whereby the assembly elements each respectively comprises two side walls on the upper end face sides of which there is screwed a cover plate, and which are reinforced by screwing on the rearward end face sides of both of the latter-mentioned side walls a reinforcement member (which is identical to the previously mentioned reinforcement member), such that the reinforcement member of the assembly element projects downwardly beyond the side walls thereof and is screwable with its projecting part on the base element (or other assembly element) lying thereunder.

With the above and other objects and advantages in view, the present invention will become more clearly understood in connection with the following detailed description of a preferred embodiment, when considered with the accompanying drawings, of which:

Figure 1:
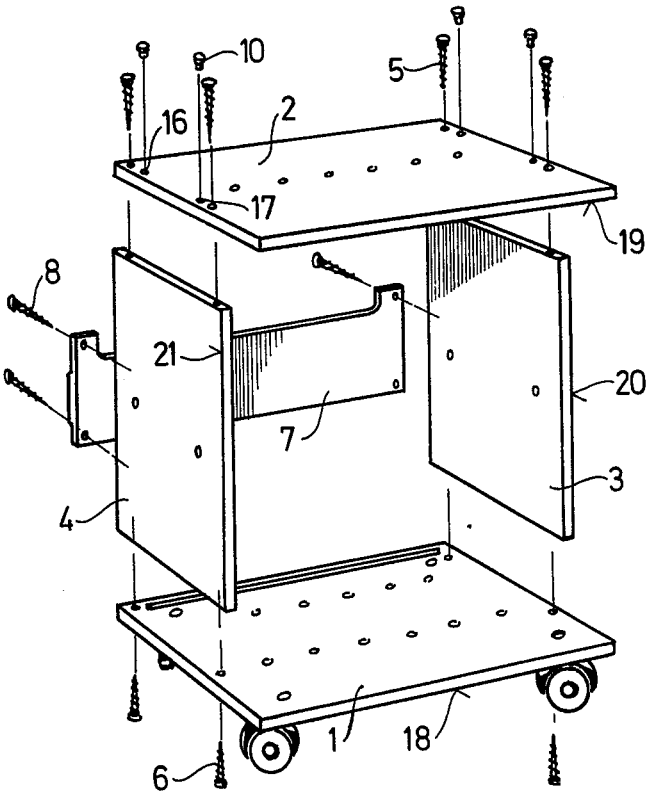
FIG. 1 is an exploded perspective view showing the individual parts of the base element of the phonostand of the present invention.

Referring now to the drawings, and more particularly to FIG. 1, a base plate 1 and a cover plate 2 are screwed with two side walls 3 and 4 by means of upper and lower screws 5 and 6, respectively, which can be set therein, to form a box shaped frame. The frame is braced and reinforced by a plate shaped reinforcement member 7 which is mounted on the rear side and is fastened thereto by means of screws 8. The totality constitutes the base element (FIG. 1) as a simplest embodiment of the phonostand.

One assembly element (FIG. 2) comprises two side walls 11 and 12 and a cover plate 13 which can be assembled together by means of screws, and can be reinforced on the rear side by screwing on a reinforcement member 7' which is identical to the reinforcement member 7 of the base element, whereby the reinforcement member 7' projects downwardly over the side walls 11 and 12.

Figure 2:
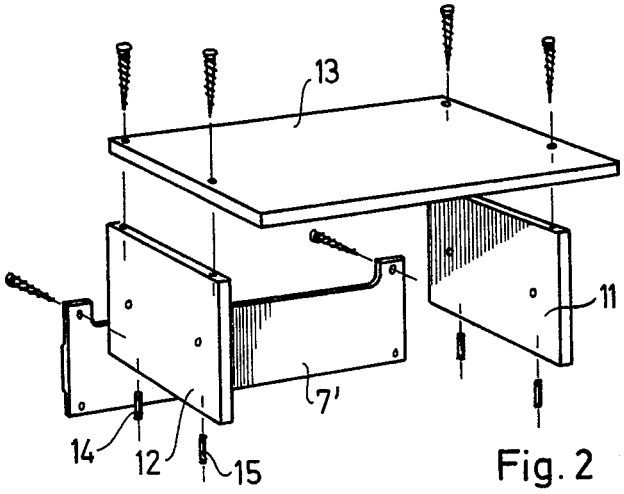
FIG. 2 is a perspective view showing the individual parts of an assembly element.

If the base element (FIG. 1) is to be widened by means of an assembly element (FIG. 2), the assembly element is mounted on the base element by means of two pins or dowels 14 and 15, which dowels are plugged into prepared bores 16 and 17 in both of the base element (FIG. 1) and the assembly element (FIG. 2). The bores 16 and 17 in the cover plate 2 are coverable by synthetic plastic material caps 10 when not used to mount an assembly element thereon. For safety and security against unintended lifting of the assembly elements and for the additional reinforcement of the entire unit, the reinforcement member 7' of the assembly element is also screwed tightly onto the rear side of the base element with its lower part which projects downwardly (FIG. 3).

Figure 3:
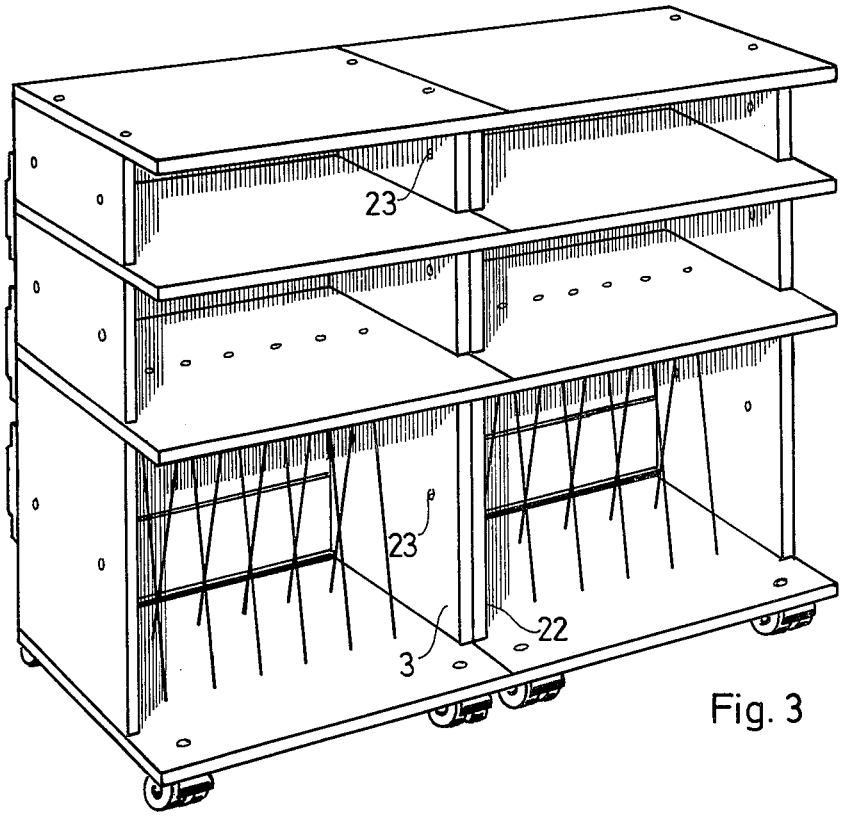
FIG. 3 is a front perspective view of a phonostand composed of a plurality of elements.

In FIG. 3 a phonostand is illustrated, which comprises two units which are screwed together by means of screws 23 with their side walls 3 and 22, whereby as illustrated each unit comprises a base element and two assembly elements, the latter two assembly elements each having different heights.

The front end surfaces 18 to 21 of the bottom plate 1 and the cover plate and of the side walls 3 and 4, respectively, are colored black. The remaining surfaces of the bottom plate and cover plate are colored walnut on one side and black on the other side, and the screw holes and the pin holes, respectively, are arranged such that all plates can be selectively mounted upwardly or downwardly, respectively, with one or the other side, which substantially simplifies the type holding by the manufacturer and dealer, since depending upon the assembly, two different type stands arise.

The reinforcement members 7 and 7' are formed alike and have an upper recessed section forming a U-shaped upper edge contour defining lateral upwardly projecting tub sections through which the screw holes, e.g., for the screws 8 of FIG. 1, are provided.

While I have disclosed one embodiment of the present invention it is to be understood that this embodiment is given by example only and not in a limiting sense.

I claim:

1. A stand for the insertion and setting up, respectively, of electro-acoustic devices of general use, comprising a bottom plate, a first cover plate spaced apart from said bottom plate, two first side walls spaced apart from one another having end face sides disposed abuttingly between said bottom plate and said first cover plate, said two first side walls also having rear end face sides, first screw means for screwing said bottom plate and said first cover plate onto said end face sides of said two first side walls and forming a base element therewith, a reinforcement member comprising a plate-shaped plastic molded part having and covering only a portion of the total height of said first side walls disposed against said rear end face sides of said two first side walls, second screw means for screwing said reinforcement member onto said rear end face sides of both of said two first side walls, two second side walls having upper end face sides, back end face sides and lower end face sides, a second cover plate of the same width as that of said first cover plate, third screw means for screwing said second cover plate on said upper end face sides of both of said two second side walls and forming therewith an assembly element having dimensions substantially corresponding to that of a conventional phonotable, a second reinforcement member identical to said first-mentioned reinforcement member, said second reinforcement member having a lowermost projecting section, fourth screw means for screwing said second reinforcement member on said back end face sides of both of said two second side walls in a position with said projecting section of said second reinforcement member projecting downwardly beyond said two second side walls, said assembly element being mountable on said base element with said lower end face sides of said two second side walls abutting on said first cover plate, fixing means cooperatively arranged between both of said second side walls of said assembly element and said first cover plate of said base element for bringing said two first side walls and said two second side walls of said base element and said assembly element, respectively, in corresponding alignment coincidence, respectively, upon mounting of said assembly element on said base element, fifth screw means for screwing said projecting section of said second reinforcement member of said assembly element with said base element, the latter disposed under said assembly element.

2. The stand as set forth in claim 1, further comprising a plurality of said base elements disposed adjacent one another, a plurality of said assembly elements mounted on said base elements one above the other, respectively, sixth screw means for joining adjacent of said base elements and of said assembly elements together.

3. The stand as set forth in claim 2, wherein said plurality of assembly elements selectively have the same height.

4. The stand as set forth in claim 2, wherein said plurality of assembly elements selectively have different heights.

5. The stand as set forth in claim 1, wherein said bottom plates, said side walls and said cover plates each include inner and outer surfaces, respectively, opposite one another having a different character, and said screw means and said fixing means are arranged such that said bottom plates, said cover plates and said side walls, selectively, are assemblable with one of said two surfaces outwardly and upwardly respectively.

* * * * *